US007464923B2

(12) United States Patent
Faguy et al.

(10) Patent No.: US 7,464,923 B2
(45) Date of Patent: Dec. 16, 2008

(54) MULTI-SECTIONED PAPER HANDLING TIRE

(75) Inventors: Gary A. Faguy, Hamilton (CA); John F. Lombardo, Woodbridge (CA); Salvatore J. Provvidenza, Ajax (CA)

(73) Assignee: Xerox Corporation, Norwalk, CT (US)

( * ) Notice: Subject to any disclaimer, the term of this patent is extended or adjusted under 35 U.S.C. 154(b) by 440 days.

(21) Appl. No.: 11/429,007

(22) Filed: May 5, 2006

(65) Prior Publication Data

US 2007/0257414 A1 Nov. 8, 2007

(51) Int. Cl.
*B65H 3/06* (2006.01)

(52) U.S. Cl. ..... 271/109; 271/275; 271/314; 492/36; 492/39; 492/40

(58) Field of Classification Search ..... 271/4.08, 271/4.1, 10.09, 10.11, 109, 275, 314; 492/36, 492/39, 40

See application file for complete search history.

(56) References Cited

U.S. PATENT DOCUMENTS

| | | | | | |
|---|---|---|---|---|---|
| 1,284,443 | A | * | 11/1918 | Plant | 492/40 |
| 1,600,841 | A | * | 9/1926 | Neall | 492/40 |
| 2,186,890 | A | * | 1/1940 | Wilkie | 492/40 |
| 2,247,874 | A | * | 7/1941 | Crites | 492/33 |
| 5,267,008 | A | | 11/1993 | Rebres et al. | |
| 5,725,209 | A | * | 3/1998 | Takahashi et al. | 271/122 |

* cited by examiner

*Primary Examiner*—David H Bollinger

(57) ABSTRACT

An improved device and method for providing increased latitude of paper handling tires includes at least three elastomeric materials mounted on a shaft and divided into three or more torus-shaped sections of varied width. Combinations of EPDM, Silicone and Isoprene are examples of materials that can be used to make the paper handling tires.

18 Claims, 3 Drawing Sheets

MULTI-SECTIONED PAPER HANDLING TIRE

This invention relates in general to an image forming apparatus, and more particularly, to an image forming apparatus employing improved paper handling tires used to feed sheets of any type from a stack along a predetermined path.

In reprographic machines, an important operation involves the feeding of copy sheets and document sheets. Usually, original documents are re-stacked in the tray of a recirculating document handler after they have been copied and completed copies are stacked in an output tray of the machine. Within the machine itself, duplex copies may be stacked in an intermediate storage tray between the two printing operations that are required to place images on both sides of the copy sheets. Various types of paper handling feeders are sometimes used in these environments.

One example of the heretofore mentioned paper handling feeders is a friction retard feeder that utilizes a retard member that requires a specified minimum and maximum value of coefficient of friction for adequate performance encounter early system life failure due to contamination from paper dust and fuser oil. For example, when using these friction retard feeders to function in duplex and virgin sheet or multi-sheet inserter modes on demand, i.e., one piece of hardware is used alternatively as duplex, then as plain sheet feeder, a problem arises. The problem in this type of application is that the fuser release agent (Silicone oil) on copies classically contaminates the feed element, reducing its friction and thereby impacting decisions on stack normal force, i.e., an increase in stack normal force is designed into the feeder to offset a reduced friction coefficient. This increased normal force increases other failure modes including multi-feeding and sheet damage. Other feeder design trade offs may also be necessitated, such as, special retard entrance geometry, entrance gates, complex normal force control devices, etc.

To date, most retard roll tires have been made of a single material. The choice of material has evolved in order to bring a solution to each new and unforeseen problem inherent to every material. That is, each material has a list of advantages and disadvantages. Materials are chosen based on these advantages (coefficient of friction, hardness, wear, etc.) in order to solve current problems only to have one of their disadvantages develop into a new problem. An example would be the move from an Ethylene Propylene Diene Monomer (EPDM) to Silicone tires. EDPM tires have shown to be hard and wear slowly, but causes de-lamination of originals and become contaminated because of their inability to shed their outer skin at an appropriate rate. A move to a Silicone tire solved the de-lamination and contamination problem, but due to its softness, the tire was susceptible to surface indentations, which led to flat spotting.

An example of a suggested solution to the above-mentioned problem is described in U.S. Pat. No. 5,267,008, which discloses a friction retard feeder system for feeding both virgin and simplexed sheets (sheets with image on one side) that comprises a composite friction feed roll that includes one material which feeds virgin sheets well and another material which reliably feeds sheets that have passed through fusing and have oil on their surface. Suitable material combinations are disclosed as including Silicone and Isoprene rubber.

Obviously, it would be advantageous, since there is still a need, to offer increased paper handling latitude by stabilizing the feed element coefficient.

Accordingly, as an example, an improved device and method for providing increased latitude of retard roll tires used in friction retard paper feeders is disclosed that includes mounting at least three elastomeric materials on a shaft divided into three or more torus-shaped sections of varied width. Combinations of EPDM, Silicone and Isoprene are examples of materials that can be used to make the retard roll tires.

The disclosed reprographic system that incorporates the disclosed friction retard paper feeder with improved paper handling tires may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein.

Figure 1:
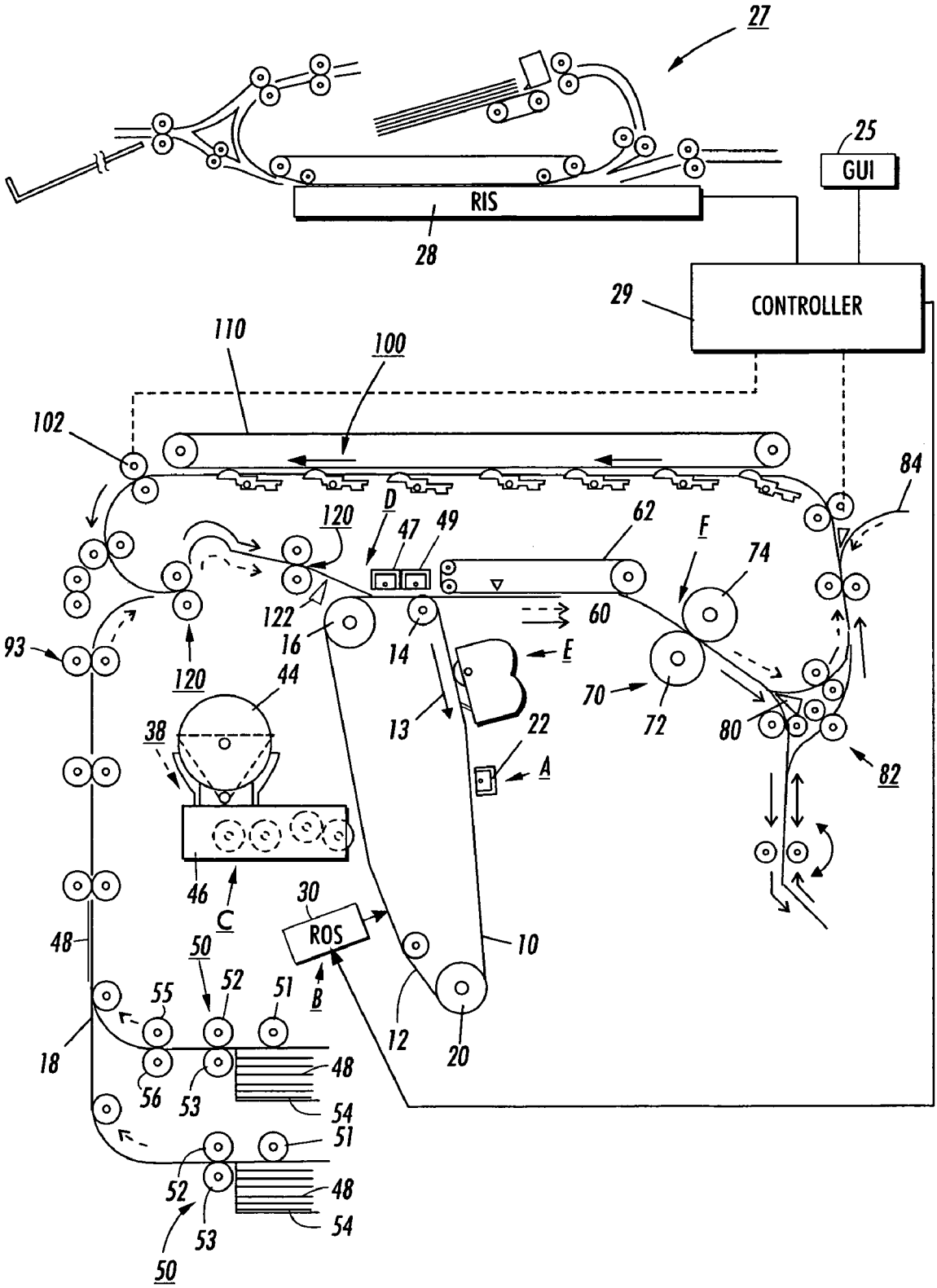
FIG. 1 is an exemplary xerographic printer that includes improved paper handling tires in a friction retard feeder apparatus.
Figure 2:
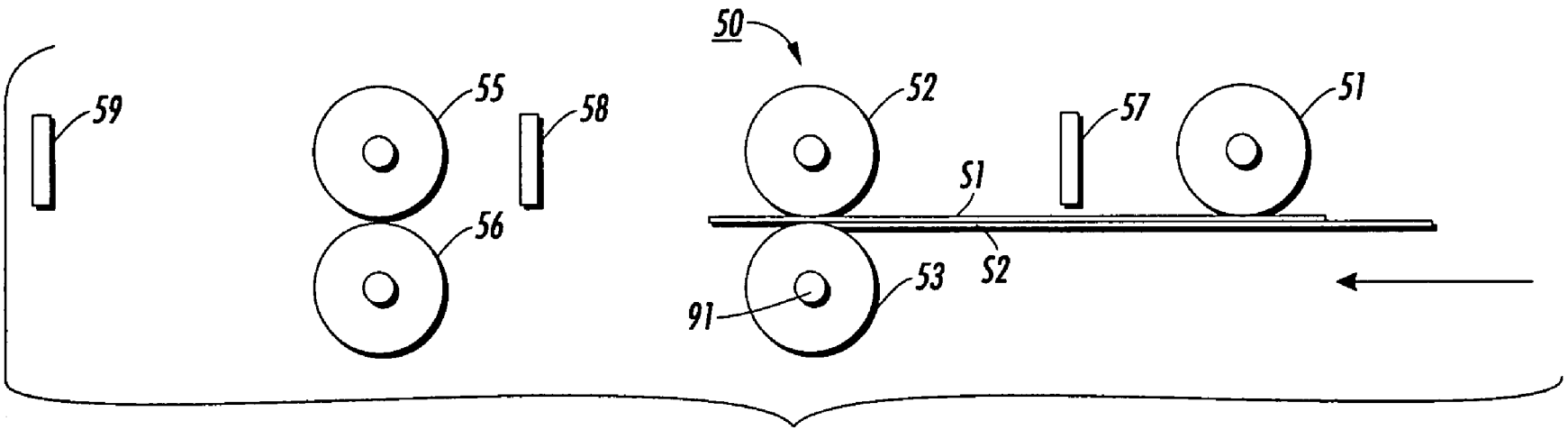
FIG. 2 is an exploded, partial schematic side view of a one embodiment of the retard sheet feeder apparatus including the improved paper handling tires.

While the disclosure will be described hereinafter in connection with preferred embodiments thereof, it will be understood that limiting the disclosure to those embodiments is not intended. On the contrary, it is intended to cover all alternatives, modifications and equivalents as may be included within the spirit and scope of the disclosure as defined by the appended claims. For example, the multi-sectioned paper handling tire composition described hereinafter applies to nudger rolls, feed rolls and paper transport rolls within all paper handling mediums (e.g., dedicated automatic document handling systems, booklet makers, input-output devices, etc.), and anyplace where a feature trade-off between more than one materials type (e.g., life vs. cost vs. de-lamination, etc.)

The disclosure will now be described by reference to a xerographic printing apparatus employing improved paper handling tires.

For a general understanding of the features of the disclosure, reference is made to the drawings. In the drawings, like reference numerals have been used throughout to identify identical elements.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge couple device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to a nip formed by feed roll 52 and a retard roll 53. Retard roll 53 is shaft mounted and controlled by controller 29 through a conventional clutch, such as, a wrap spring clutch as disclosed in U.S. Pat. No. 3,905,458. Feed roll 52 rotates to advance the sheet from stack 54 into vertical transport 18. Vertical transport 18 directs the advancing sheet 48 of support material into the registration transport 120 which, in turn, advances the sheet 48 past image transfer station D to receive an image from photoconductive belt 10 in a timed sequence so that the toner powder image formed thereon contacts the advancing sheet 48 at transfer station D. Transfer station D includes a corona generating device 47 which sprays ions onto the back side of sheet 48. This attracts the toner powder image from photoconductive surface 12 to sheet 48. The sheet is then detacked from the photoreceptor by corona generating device 49 which sprays oppositely charged ions onto the back side of sheet 48 to assist in removing the sheet from the photoreceptor. After transfer, sheet 48 continues to move in the direction of arrow 60 by way of belt transport 62, which advances sheet 48 to fusing station F.

Fusing station F includes a fuser assembly indicated generally by the reference numeral 70, which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher of stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transport station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor that controls all of the machine functions hereinbefore described. The controller provides a comparison count of the copy sheets, the number of documents being recirculated, the number of documents being recirculated, the number of copy sheets selected by the operator, time delays, jam corrections, receive signals from full width or partial width array sensors and calculate skew in sheets passing over the sensors, calculate the change in skew, the speed of the sheet and an overall comparison of the detected motion of sheets with a reference or nominal motion through a particular portion of the machine.

Sheet separator/feeder 50 is a friction retard top sheet feeder that will now be described with particular reference to FIGS. 2-5. Sheets 48 are fed from a stack by nudger roll 51 which engages the top sheet in the stack and on rotation feeds the top sheet towards a nip formed between separation or feed roll 52 and retard roll 53. Feeding from tray 54 by nudger roll 51 is obtained by creating a stack normal force (e.g., of 1.5 Newtons) between the nudger roll and the paper stack. This force is achieved by the weight of the nudger wheel and its associated components acting under gravity.

At the beginning of a print cycle, the machine logic will interrogate the system to determine if any paper is in the paper path. If there is no paper in the paper path, the logic will initiate a signal to a feed clutch in nudger 51, thereby starting the feeder. The nudger roll 51 will drive the top sheet of paper 48 into the nip between feed roll 52 and retard roll 53. Microswitch 57 indicates when a sheet has been forwarded by the nudger roll. As the feed roll rotates, it drags a sheet of paper from the stack. Frictional forces and static electricity between the sheets of paper in the stack may cause several sheets to move into the nip together.

If several sheets of paper approach the nip together, the friction between the retard roll 53 and the bottom sheet of those being fed is greater than that between two sheets. The friction between the feed roll 52 and the top sheet S1 is greater than the friction between two sheets. The group of sheets being fed towards the nip will therefore tend to become staggered around the curved surface of the retard roll up into the nip, until the lower sheet S2 of the top two sheets is retained by the retard roll 53, while the topmost sheet is fed by the feed roll 52. Of course, in order for this to happen, the friction between the feed roll 52 and a paper sheet must be greater than the friction between a paper sheet and the retard roll 53. Therefore, the feed roll 52 drives the top sheet S1 away from the stack and the next sheet S2 is retained in the nip to be fed next. Microswitch 58 communicates to controller 29 whether a sheet has reached that point in feeding.

The feed clutch remains energized until paper is sensed by the input microswitch 59. Paper whose leading edge has reached this switch 59 is under the control of the takeaway rolls 55, 56 that drive the sheet towards registration transport 120. All of the heretofore mentioned rolls are preferably composite rolls made as described, for example, with reference to retard roll 53 of FIGS. 3 and 4.

Generally, there is one feed element material available through Ten Cate Enbi, Inc., 1703 McCall Drive, Shelbyville, Ind. 46176, such as, Tyre 40 degree Shore Liquid Silicone Rubber with S47 Coating that is found to be most optimal for feeding fresh copies, i.e., it functions best in the duplex feeder mode and a different feed element material, such as Isoprene (Xerox material specification No. 34-0001) that functions best as a plain paper feed element material. EPDM, also available through Ten Cate Enbi, Inc. under specification number 96.05.02.39, has been found to be optimal for use in feeding plain paper or virgin sheets, as well. These elements function best in their respective modes because their friction coefficients, against the respective sheets are relatively large and promotes and allows suitable feeder latitude in that mode, i.e., the critical feeder parameters can be varied within a range which is greater than or equal to expected manufacturing tolerances without adversely impacting feeder failure modes and rates.

Figure 3:
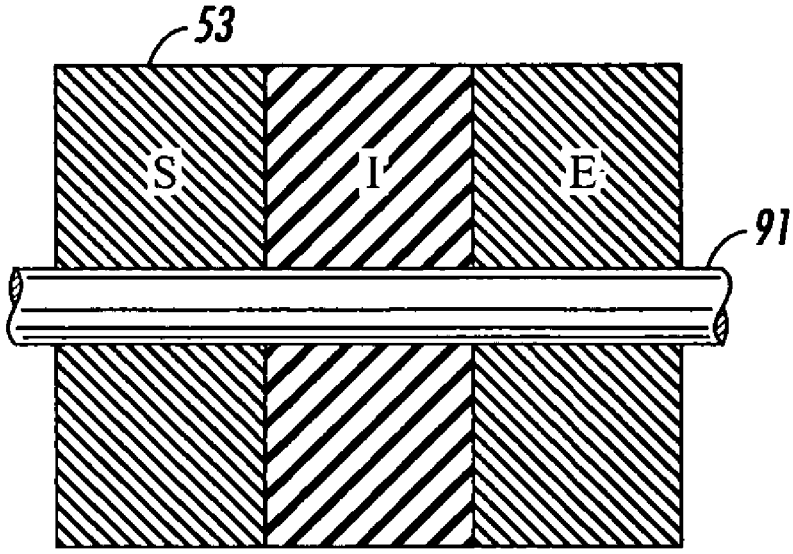
FIG. 3 is a partial schematic front view showing tire sections of different materials used in the retard roll feeder apparatus of FIG. 2.

The improved multi-sectioned, composite paper handling tire of the instant disclosure shown, for example, as a retard roll in FIG. 3, comprises at least three materials of Silicone, Isoprene and EPDM mounted on shaft or hub 91 so that each material is always present and can affect a stable composite element friction level with all sheets to be fed, including duplex copies, transparencies, virgin sheets, etc. It should be understood that other configurations of composite retard roll 53 are envisioned, such as, bar bell roll, a feed belt or a combination of the two. It should also be understood that composite roll 53 could be made of narrow annular bands of at least three different elastomer materials bonded in an alternate pattern on hub 91.

Figure 4:
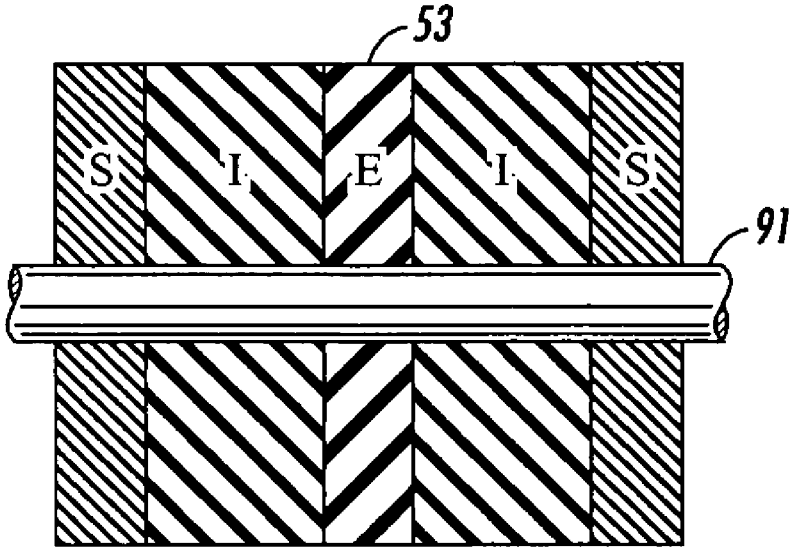
FIG. 4 is a partial schematic front view showing materials of varied section width used in the retard roll tire of the feeder apparatus of FIG. 2.

Alternatively, as shown in FIG. 4, retard roll 53 is shown as comprising varied annular band section widths of Silicone, Isoprene and EPDM.

It should now be understood that a paper feed system has been disclosed that employs an improved retard roll tire that can optimally feed both virgin sheets and imaged sheets. A problem arises in selecting a retard roll material for this application since the material of choice for virgin paper, namely Isoprene, is not the material of choice for fused copies that are to be duplexed. Isoprene and EPDM provide very high friction when feeding virgin paper, but the fuser oil found on fresh imaged or fused copies degrades that friction to an unacceptably low level. Silicone rubbers are typically used to provide a retard force to fused copies since the friction of these materials do not degrade as badly as others. Unfortunately, Silicone rubbers are easily contaminated by virgin paper debris making this an undesirable choice for feeding virgin paper. In answer to this problem, a composite, multi-sectioned retard roll tire is provided where the tire is made up of at least three materials divided into three or more torus-shaped sections of varied width. The intent of the design is to have multiple material properties working together in order to negate certain downfalls that an individual material may carry. Combining three or more materials leads to better overall properties over life of the retard roll tire and all other paper handling tires used in the xerographic system regarding to wear, flat spots, de-lamination and contamination failure. Also, a decrease in materials cost is realized since the inclusion of EPDM means less Silicone will be used in a tire.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A reprographic device, comprising:

a scanning member for scanning a document;

an image processor for receives image data from said scanning member and processing it;

a sheet feeder, said sheet feeder including a separation roll that feeds copy sheets to receive images thereon from said image processor, said separation roll including a composite of at least three elastomer materials with each of said at least three elastomer materials being positioned to contact the copy sheets during feeding; and at least one output tray for receiving the imaged copy sheets.

2. The reprographic device of claim 1, wherein said composite of at least three elastomer materials include Silicone, Isoprene and EPDM portions.

3. The reprographic device of claim 2, wherein said Silicone, Isoprene and EPDM portions are mounded on a shaft, and wherein said Silicone, Isoprene and EPDM portions comprise axially extending annular bands positioned on said shaft.

4. The reprographic device of claim 3, wherein said axially extending annular bands are varied in width.

5. The reprographic device of claim 1, including a retard roll positioned to form a nip with said separation roll to feed sheets, and wherein said retard roll includes a composite of at least three elastomer materials.

6. The reprographic device of claim 5, including a clutch operatively connected to said shaft of said retard roll and wherein said clutch is controlled by a controller.

7. The reprographic device of claim 6, wherein said sheet feeder includes takeaway rolls, and wherein torque on said retard roll is reduced once a sheet reaches said takeaway rolls.

8. A sheet feeder system, comprising:

a sheet support member for supporting a stack of sheets for feeding in a predetermined direction; and a shaft mounted separation roll that feeds sheets from the stack to receive images thereon from an image processor, and wherein said separation roll comprises a composite of at least three elastomer materials with each of said at least three elastomer materials being positioned to contact the sheets during feeding.

9. The sheet feeder system of claim 8, wherein said at least three elastomer feed roll materials includes sections of Silicone, Isoprene and EPDM.

10. The sheet feeder system of claim 9, including a retard roll that forms a nip between said separation roll and said retard roll, and wherein said retard roll comprises a composite of at least three elastomer materials.

11. The sheet feeder system of claim 9, wherein said sections of Silicone, Isoprene and EPDM are varied in width.

12. The sheet feeder system of claim 11, including a clutch operatively connected to said retard roll, and wherein said clutch is controlled by a controller.

13. A method for improving the life and reliability of a paper handling tire, comprising:

providing a shaft;

providing at least three bands of elastomeric material; and mounting said at least three bands of elastomeric material on said shaft and adjacent to each other such that each of said three bands of elastomeric materials has a non-covered outer surface lengthwise of said shaft to form said paper handling tire.

14. The method of claim 13, including providing said at least three bands of elastomeric material in the form of Silicone, Isoprene and EPDM.

15. The method of claim 14, wherein said elastomeric bands are annular in shape.

16. The method of claim 15, including providing a shaft mounted retard roll tire positioned to form a nip with a sheet separation roll tire in order to feed separate sheets from a stack of sheets, and a clutch operatively connected to said shaft of said retard roll tire.

17. The method of claim 16, including controlling said clutch with a controller.

18. The method of claim 17, including providing takeaway rolls with each roll comprising a composite of at least three elastomer materials, and wherein torque on said retard roll is reduced once a sheet reaches said takeaway rolls.

* * * * *